United States Patent [19]

Beggs et al.

[11] 4,096,918

[45] Jun. 27, 1978

[54] METALLURGICAL VAT SUPPORT SYSTEM

[75] Inventors: James Ingram Beggs, Hamilton, Canada; Karlheinz Langlitz, Mulheim, Germany; Gunter Schmitz, Duisburg, Germany; Wolfgang Jansa, Moers, Germany

[73] Assignee: Demag Aktiengesellschaft, Duisburg, Germany

[21] Appl. No.: 765,795

[22] Filed: Feb. 4, 1977

[30] Foreign Application Priority Data

Feb. 5, 1976 Germany ..... 2604353

[51] Int. Cl.[2] ..... G01G 19/00

[52] U.S. Cl. ..... 177/145; 266/78

[58] Field of Search ..... 177/145, 260; 266/78

[56] References Cited

U.S. PATENT DOCUMENTS

| | | | |
|---|---|---|---|
| 2,213,982 | 9/1940 | Frey et al. | 177/211 |
| 3,256,948 | 6/1966 | Annen et al. | 177/211 X |
| 3,319,728 | 5/1967 | Johansson et al. | 177/211 X |
| 3,345,058 | 10/1967 | Pere | 266/78 |
| 3,652,072 | 3/1972 | Stresemann et al. | 266/36 P |

*Primary Examiner*—George H. Miller, Jr.
*Attorney, Agent, or Firm*—Mandeville and Schweitzer

[57] ABSTRACT

A metallurgical tilting vat, such as a steel mill converter, which, by means of vat extensions or projections, rests on a surrounding tilting mechanism, so that it can be tilted 360°, and where radial and axial heat expansion and contractions are accommodated. The tilting mechanism is equipped with dynamic test cells for weighing the vat and/or vat contents. This type of metallurgical tilting vat equipped with weighing devices serves to ascertain the vat contents in order to observe the steel production process based on differing weights of the vat contents, and, in turn, to regulate the decarbonization process based on the weight data and/or data graphs thus obtained.

10 Claims, 7 Drawing Figures

METALLURGICAL VAT SUPPORT SYSTEM

BACKGROUND AND STATEMENT OF THE INVENTION

A metallurgical vat for continuous weighing of oxygen converters to regulate the blowing process has been disclosed in the publication "Steel and Iron" Volume 95, 1975, page 1099, where the housing of the horizontal pivot pin supports is placed on dynamic test cells. Such measuring apparatus does not provide accurate results for various reasons. The inner masonry lining of metallurgical vats usually wears irregularly. After a certain period of time, the masonry is eroded, and causes a change in the total center of gravity. Furthermore, slag deposits weighing several tons form at the vat nozzle, which also cause an irregular unbalanced load.

The manufacture of a metallurgical vat is not so exact that the center of gravity of the vat is located on the vertical plane of the pivot pin axis. The shifting in weight in the masonry, nozzle deposits, and manufacturing inaccuracies, individually and combined, lead to a shift in the total center of gravity, even in the normal position of the metallurgic vat, when the nozzle opening is pointed upward. The distance of the actual center of gravity from the pivot pin axis causes additional torque around the pivot pin axis so that the pivot pin support has a tendency to rotate. Only the dynamic test cells hinder such rotation. This torque results in a horizontal force which puts undue stress on the dynamic test cells. Such dynamic test cells may consist of hydraulic piston and cylinder units, of solid bodies such as quartz crystals, or of mechanical compression spring units with selected characteristics. Each type of dynamic test cell, however, shows accurate results only under an exactly balanced load. The disclosed solution lacks measures to keep the horizontal forces mentioned above from influencing the dynamic test cells.

Such inaccurate weighing is avoided in another known proposal in German Patent No. DT-PS 2 018 251. The pivot pin bearings subjected to horizontal forces support themselves on platforms or bridges which in turn are supported on the dynamic test cells. Horizontal movements of the platforms are not possible as the latter are hinged in a fixed location by means of tension joints. The tilting gear torque, too, which may lead to loads on the dynamic test cells, rests on the platform. Despite the fact that the absorption of horizontal forces, i.e. keeping these forces away from the dynamic test cells, has been accomplished, doubts still remain as to the accuracy of the results obtained from weighing. The reason for this is the unusually unfavorable ratio of empty (net) weight of the metallurgic vat (vat shell, parts of tilting mechanism and masonry) vs. the test weight. The test weight ranges within several tons, whereas the net weight of the metallurgic vat is about 1000 tons. Consequently, the ratio between net weight and test weight ranges on a scale of 1:100 to 1:1000.

The present invention is directed to the problem of arranging the dynamic test cells to facilitate a more accurate determination of vat contents, and monitoring the specific metallurgic process being carried out, such as in the production of steel. The invention solves this by arranging the dynamic test cells in each case between opposed surfaces on the vat projection or extensions, and bearing surfaces on the tilting mechanism. The dynamic test cells, together with axially expandable, radially flexible connecting elements positioned essentially parallel with the vat axis, and which rig the vat projections with the tilting mechanism, form a tilting or swiveling vat mounting within the tilting mechanism. This arrangement of the invention has two results in that the principle of a mere weighing apparatus is improved upon by combining the means for weighing with a tilting system. The invention then combines this tilting system with the mounting of the tilting vat within the tilting mechanism permitting heat expansion of the tilting vat. The defects of the arrangement of dynamic test cells directly between vat extensions and the tilting mechanism, within the tilting mechanism, are thus eliminated.

The tilting capacity of the mounting of the invention may be influenced through a choice of connecting elements, such as rods, wires, or similar devices. Another measure to keep the vibration frequency of the tilting system within still closer limits, is to place the dynamic test cells under an initial load in the normal position of the vat. For even further restricted adjustment of the vibration frequency of the swiveling or oscillating system, the dynamic test cells are placed under an initial load even outside the normal vat position, with such initial load being greater than the weight of the vat with its respective contents and being applied via an initial tension of the connecting elements between the vat projections and the tilting mechanism.

Weighing of the metallurgical tilting vat is usually done in the normal position where the tilting vat opening points up. In order to preclude the influence of forces directly transverse to the rest direction of the dynamic test cells, each dynamic test cell is centrally located between a pair of the axially expandable and radially flexible connecting elements, and the axes of the connecting elements as well as the axes of the dynamic test cells are parallel.

In view of the heat effect near the metallurgical tilting vat it is practical to take special steps to protect the dynamic test cells. In the arrangement of this invention, each dynamic test cell is located in a protective housing with one side thereof closed and affixed to the adjacent vat projection or tilting mechanism, and with an open side supported via a die on a slide surface positioned at right angles to the load direction at the vat projection and/or tilting mechanism.

Practitioners in the art prefer that the dynamic test cells are positioned only in the outer areas of metallurgic tilting vats. Thus, special measures must be taken for the arrangement of the dynamic test immediately between the vat projection and the tilting mechanism as taught by the invention. Principally, this involves accommodating the heat expansion movements between the vat projection and the tilting mechanism. The invention solves this problem of expansion and contraction in the vat axis direction by arranging the die at the open side of the unilaterally closed housing so that it may slide in the load direction. Expansion movements transverse to the tilting vat axis are accommodated by giving the die a spherical hollow surface for the support of the dynamic test cell.

It is of advantage to affix the dynamic test cell without axial displacement to the closed side of the unilaterally closed housing. To protect the dynamic test cell from heat influences of the metallurgic tilting vat, the housing for the dynamic test cell is provided with a cooled shell. The dynamic test cells distributed evenly over the circumference of the tilting vat and/or tilting mechanism are used to ascertain one single test signal. To this end, all dynamic test cells are connected to an electric test data storage and/or test data reference instrument, which is equipped with a meter to indicate the mean value of the weight data.

As purely illustrative of apparatus for carrying out the invention, one may note the attached drawings in which the mounting for a vat in a steel mill converter is shown.

DETAILED DESCRIPTION OF A PREFERRED EMBODIMENT OF THE INVENTION

Figure 1:
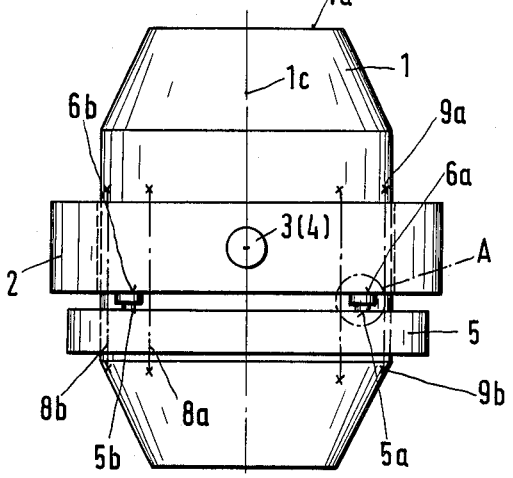
FIG. 1 is a view in elevation of a metallurgical tilting vat, showing part of the tilting mechanism embodying the invention.

FIG. 1 of the drawings shows a steel mill converter as a metallurgical tilting vat 1. Such tilting vats are commonly provided with a tilting structure consisting of annular support 2 with pivot pins 3 and 4 located on the central horizontal axis of vat 1, as well as pivot bearings (not indicated) for pivot pins 3 and 4. The tilting vat 1 may rest immediately on the pivot bearings without annular support 2. However, annular support 2 permits, whether connected directly to vat 1 or spaced from it, a relatively free heat expansion of tilting vat 1 without constraint. Tilting vat 1 is, to this end, provided with grappling or claw ring 5 rigidly attached to the vat shell, such grappling or claw ring 5 permitting a choice of any number of vat projections. In lieu of ring 5, provision may be made for single grappling hooks distributed over the circumference.

In the embodiment of FIG. 1, the ring 5 forms four vat projections or extensions spaced circumferentially, of which vat projections 5*a* and 5*b* are visible. Annular support 2 forms, in each case, opposite bearing surfaces 6*a*, 6*b*, and between each vat projection and bearing surface rests a dynamic test cell 7 in a certain arrangement which is explained below in FIGS. 6 and 7.

Figure 5:
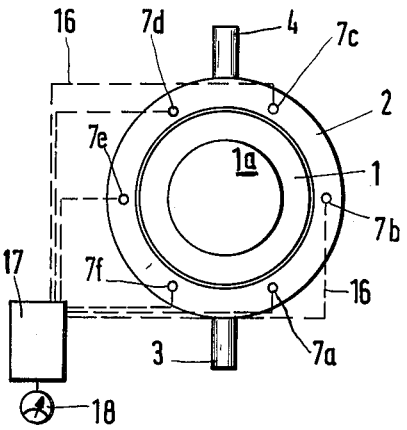
FIG. 5 is a schematic illustration for several cooperating dynamic test cells in the arrangement of the invention.

In the normal position of tilting vat 1 shown in FIG. 1, with tilting vat nozzle 1*a* pointing up, the empty weight of the vat together with the weight of contents (liquid iron, scrap charge, ore, lime, etc.) hangs on connecting elements 8*a* and 8*b* transmitting great tensile forces, such connecting elements 8*a* and 8*b* being shown symbolically as axles and consisting of rods, wires, or pipes. The flexible connecting elements are always under sufficient or more tensile stress so that the dynamic test cells 7*a* through 7*f* (FIG. 5) are under a load of zero or greater. The distance between points of attachment 9*a* and 9*b* of each connecting element at the tilting vat and/or the tilting mechanism is chosen rather large to reduce the structural requirements of annular support 2. With a large distance between points of attachment 9*a* and 9*b*, only minor bending of the connecting elements occurs during shifting of the points of attachment at the tilting mechanism (at annular support 2), and at the tilting vat 1 (vat projections 5*a*, 5*b*, etc.), so that the dynamic test cells 7 are subjected to fewer horizontal forces.

The connecting elements such as 8*a* and 8*b*, furthermore, run approximately parallel with the tilting vat axis 1*c* (FIG. 1). The sum of the initial tension forces of all connecting elements 8 combined according to FIG. 1 is greater than the tilting vat weight, including the weight of ring 5 as well as the weight of the contents. In the 180° position with tilting vat nozzle 1*a* pointing down, no initial tension is necessary, and it will be very low.

Figure 2:
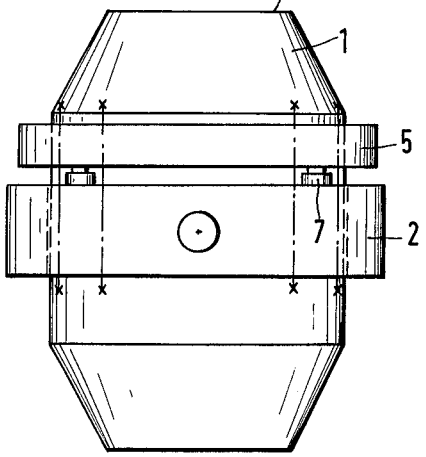
FIG. 2 is a view in elevation of the vat of FIG. 1, with a modified arrangement of construction.
Figure 3:
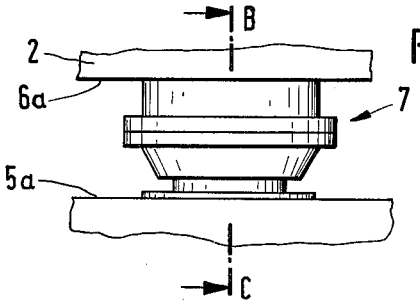
FIG. 3 is an enlarged view of that portion of FIG. 1 marked as A, and showing details of the mounting of the dynamic test cells according to the invention.

The same principle of fastening the dynamic test cells between vat projection and tilting mechanism is used in reverse according to FIG. 2. In the normal position with tilting vat nozzle 1*a* pointing up shown on FIG. 2 as well, tilting vat 1 supports itself by means of ring 5 fastening the dynamic test cells 7 on annular support 2. This position only requires a low initial tension of connecting elements 8. Theoretically, the initial tension might equal zero. However, in a 180° tilted position relative to FIG. 2 it is as great as in the normal position of FIG. 1. The dynamic test cells 7 (FIG. 3) are fastened to a greater or lesser degree in the described conditions of initial tension. At times, however, they may (when not in operation) be subjected to slight lateral displacement, either on bearings 6 or on vat projections such as 5*a*, 5*b*.

Figure 4:
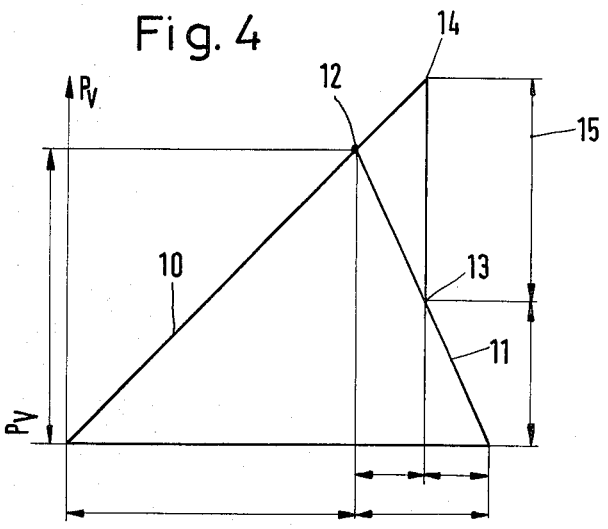
FIG. 4 is a graph illustrating diagramically the load factors in the dynamic test cell arrangement of the invention.

Initial tension conditions are explained with FIG. 4. The ordinate stands for initial tension $P_V$, the abscissa for the expansion of connecting elements 8*a*, 8*b*, as well as for shortening of annular support 2 and ring 5. The dynamic expansion line of the connecting elements, called 10, and the dynamic shortening line of the annular support with the claw ring, called 11, intersect at point 12. A favorable, i.e. low initial tension force is obtained in the area of the selected triangle 12, 13, 14. Thus, change in the initial force only takes place with 15, rising from zero (at 13) to the maximum value (at 14). The dynamic test cells 7*a* through 7*f* (FIG. 5) are connected to the electric test data storage and test data reference instrument 17 by means of cables 16. The weight data ascertained can be read on meter 18, connected to instrument 17.

Figure 6:
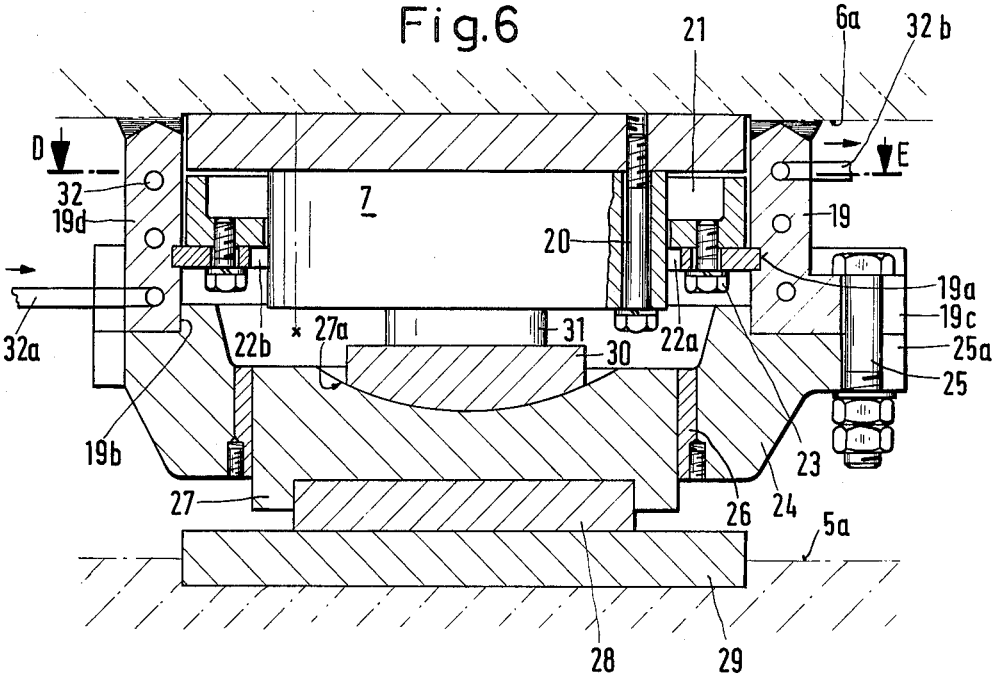
FIG. 6 is a view in cross-section along lines B–C of FIG. 3.
Figure 7:
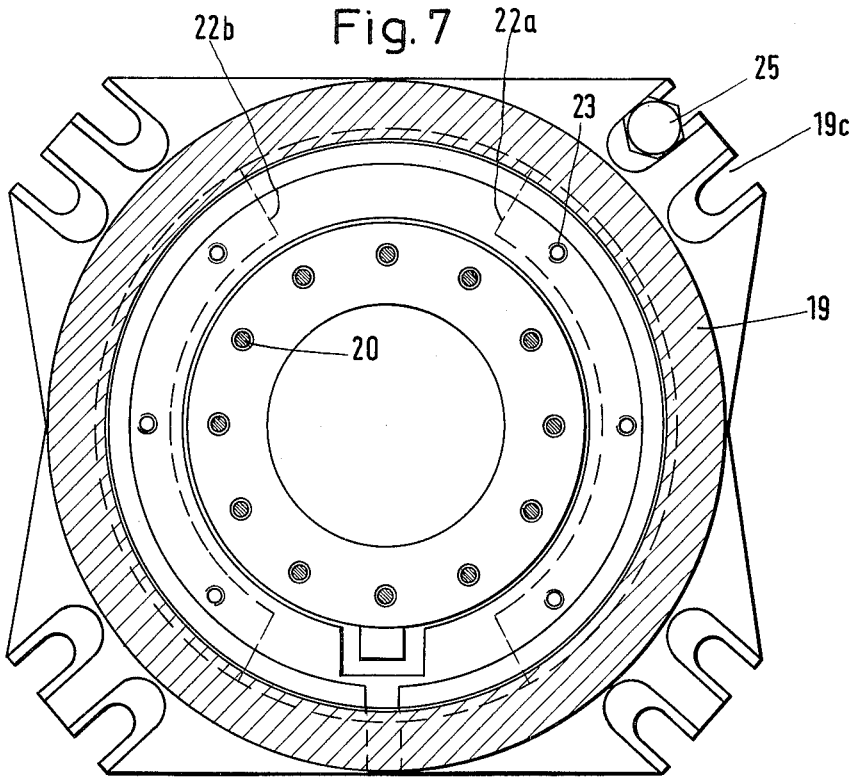
FIG. 7 is a view in cross-section along lines D–E of FIG. 6.

The weighing and swivel system according to the invention operates as follows. During the decarbonization process of the oxygen injection method or generally during stronger reactions in metallurgic refining methods, vibrations occur within the liquid metal and/or the slag layer which are transmitted via the masonry lining to the vat. The oxygen injection process furthermore develops from time to time violent gas formations which also cause vibrations in the vat. The arrangement of dynamic test cells according to the invention serves to register such vibrations. Each dynamic test cell 7*a* through 7*f* (FIG. 5) has a unilaterally closed housing 19 which is (as shown) attached to bearing 6*a* (6*b*) of annular support 2 (by welding), (FIGS. 6 and 7). Several screws 20 and a spacer ring 21 supported by annular segments 22*a*, 22*b* inserted in annular grooves 19*a* of housing 19, via screws 23, safeguard dynamic test cells 7 against axial displacement, and also facilitate assembly. Open side 19*b* of housing 19 is covered by ring 24.

Ring 24 can, by means of screws 25 and slots 19c and 25a, be removed or assembled without any difficulty even if the distance between vat projections 5a, 5b etc. and the tilting mechanism is small. A further advantage lies in the development of ring 24 as a cap with stationary bushing 26 for axially movable die 27. Die 27 is, provided with slide face 28 facing bearing 5a and guarantees slight sliding on a further slide face 29 during non-testing phases. Die 27 is furthermore provided, towards dynamic test cell 7, with a spherical hollow surface 27a for cooperative sliding engagement with intermediate part 30, supporting base 31 of dynamic test cell 7, to compensate for flaws in the parts of the tilting vat and the tilting mechanism. Therefore, axial adjustment and adjustment on a conical shell are provided for the dynamic test cell 7 between the vat projections such as 5a, 5b on one hand, and opposite bearing locations such as 6a, 6b on the other hand. This type of arrangement, furthermore, permits removal of tilting vat 1 from the tilting mechanism, or installing it in the tilting mechanism, without special measures which might influence dynamic test cells 7.

To protect dynamic test cells 7 in their housings 19 from the effects of heat involved from metallurgic processes, shell 19d is provided with cooling ducts 32, cooling agent inlet 32a and cooling agent outlet 32b.

While the apparatus herein disclosed constitutes a preferred embodiment of this invention, this invention is not limited to this preferred embodiment, and changes may be made therein without departing from the scope of the invention which is defined in the appended claims.

We claim:

1. Apparatus for mounting dynamic test cells for tilting metallurgical vats to avoid outside influences from affecting the test results, comprising (a) a vat;

(b) extension means fixed to said vat and extending radially therefrom;

(c) an annular ring surrounding said vat;

(d) diametrically opposed bearings in said ring;

(e) said vat supported in said ring for tilting through angles of 360°; the improvement characterized by (f) opposed horizontal surfaces on said extension means and said annular ring;

(g) a plurality of dynamic test cells mounted between said opposed horizontal surfaces; and (h) a plurality of elongated vertically disposed expandable flexible connecting elements connecting said vat, said annular ring, and said extension means;

(i) whereby tilting said vat on said bearings also tilts said dynamic test cells.

2. The apparatus of claim 1, further characterized by (a) in the non-tilting vertical position of said vat, said test cells are charged with an initial load.

3. The apparatus of claim 1, further characterized by (a) in a tilting position of said vat said test cells are charged with an initial load;

(b) said initial load being greater than the weight of said vat and the contents thereof where the vat is completely full; and (c) said charging is by applying initial tension to said connecting elements.

4. The apparatus of claim 1, further characterized by (a) said connecting elements are arranged in pairs connected to said vat;

(b) each dynamic test cell is positioned between said connecting elements of a pair; and (c) the axes of said dynamic test cells and said connecting elements are parallel.

5. The apparatus of claim 1, further characterized by (a) a test data reference instrument;

(b) each said dynamic test cell connected to said test data reference instrument; and (c) a meter connected to said test data reference instrument for indicating the mean value of said plurality of dynamic test cells.

6. The apparatus of claim 1, further characterized by (a) a housing for each said dynamic test cell;

(b) each housing extending between said opposed horizontal surfaces;

(c) one end of each housing being closed and being affixed selectively to said extension means or said annular ring;

(d) a die supporting its respective test cell and disposed adjacent the open end of each said housing;

(e) opposed sliding surfaces between said die and said extension means or said annular ring; and (f) said opposed sliding surfaces positioned at right angles to the load direction of the respective dynamic test cell.

7. The apparatus of claim 6, further characterized by (a) each said dynamic test cell is fixed to the closed end of its respective housing.

8. The apparatus of claim 6, further characterized by (a) cooling means associated with each said dynamic test cell housing.

9. The apparatus of claim 6, further characterized by (a) said die is mounted in said housing for relative axial movement therewith.

10. The apparatus of claim 9, further characterized by (a) opposed semi-spherical bearing surfaces on each said test cell and its respective die.

* * * * *